United States Patent [19]

Dodds

[11] 4,379,526

[45] Apr. 12, 1983

[54] ORE MILL AND METAL SEPARATING DEVICE

[76] Inventor: William E. Dodds, 478 Jessie Ave., Winnipeg, Manitoba, Canada, R3L 0P6

[21] Appl. No.: 232,916

[22] Filed: Feb. 9, 1981

[30] Foreign Application Priority Data

Apr. 21, 1980 [CA] Canada ..... 350311

[51] Int. Cl.[3] ..... B02C 4/02

[52] U.S. Cl. ..... 241/79.1; 209/184; 209/193; 209/205; 241/228

[58] Field of Search ..... 209/205, 201, 184, 192, 209/193; 241/20, 60, 79.1, 228, 230, 231

[56] References Cited

U.S. PATENT DOCUMENTS 258,578 5/1882 Hamilton ..... 209/193 X
1,077,261 11/1913 Dennison ..... 209/205 X
1,111,251 9/1914 Dennison ..... 209/205
1,736,394 11/1929 Dierker ..... 241/228 X

*Primary Examiner*—Mark Rosenbaum
*Attorney, Agent, or Firm*—Stanley G. Ade

[57] ABSTRACT

A drum is supported for rotation between two shafts having gears thereon engaging a ring gear around the outer periphery of the drum. A crushing and milling cylinder is journalled for rotation upon a vertically adjustable shaft extending freely through the entrance and exit apertures in the side plates of the drum and this shaft is supported within stationary bearings one upon each side of the drum. The sludge comprising finely crushed rock and water is discharged through the exit in one side wall and into a hopper where it is conveyed by a conveyor system over and through a bed of mercury which extracts the gold in the form of an amalgam. The sludge is then discharged from the other side of the mercury bed.

6 Claims, 5 Drawing Figures

ORE MILL AND METAL SEPARATING DEVICE

BACKGROUND OF THE INVENTION

This invention relates to new and useful improvements in ore mills and separating devices attachable thereto which is particularly suitable for use in remote areas for the processing of ore from relatively small claims.

The device is adapted to be portable and to be powered by a gasoline engine and is designed specifically for use with gold bearing ore for the extraction of gold therefrom.

Conventionally, the ore from small claims is either shipped out for treatment or alternatively, a relatively expensive and heavy duty ore mill and gold extractor plant is required.

SUMMARY OF THE INVENTION

The present invention overcomes these disadvantages and in accordance with the invention there is provided an ore mill and metal separating device, said separating device comprising in combination means to receive the mill sludge from the ore mill, conveyor means conveying said sludge from said means to receive same, a mercury bed, said conveyor moving said sludge to one side of said bed and through said bed and discharging means at the other end of said bed, said separating device including a first conveyor portion inclining downwardly at an angle from said means to receive the mill sludge, a substantially horizontal container for said mercury bed, a screw conveyor spanning said container partially submerged in the mercury within said mercury bed and being operatively connected by one end thereof to one end of said first conveyor portion, and a third conveyor portion inclining upwardly at an angle from the other end of said bed and being operatively connected by one end thereof to the other end of said screw conveyor.

Another advantage of the present invention is that the device is portable and easily transported from one location to another and may include a gold extracting or metal separating device attachable to the ore mill and utilizing a mercury bed which extracts the gold from finely milled ore and water by the amalgam process.

Still another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
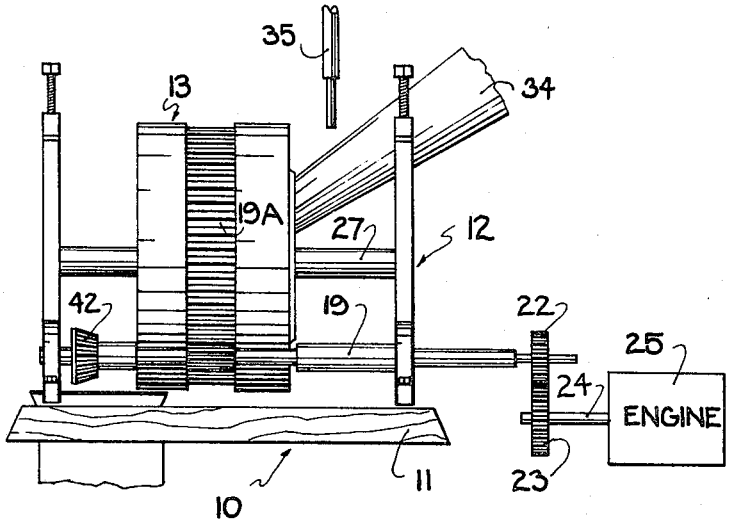
FIG. 1 is a rear end view of the ore mill.
Figure 2:
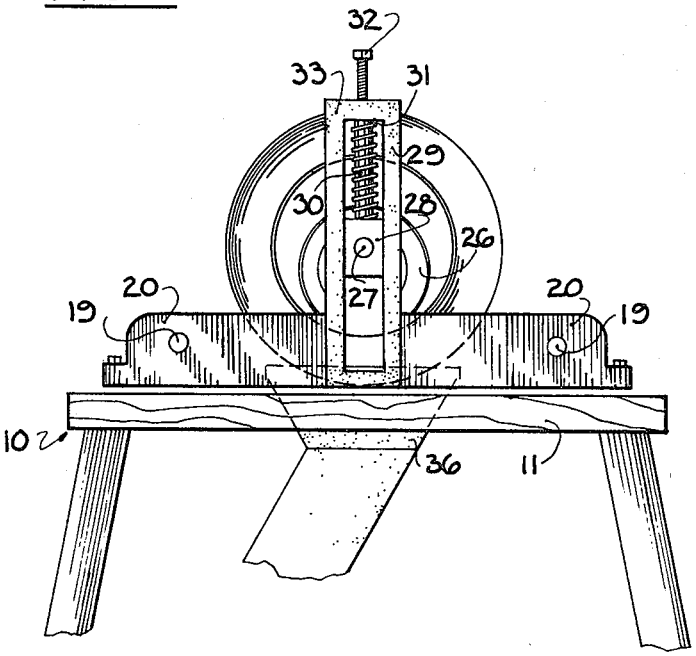
FIG. 2 is a side elevation thereof.
Figure 3:
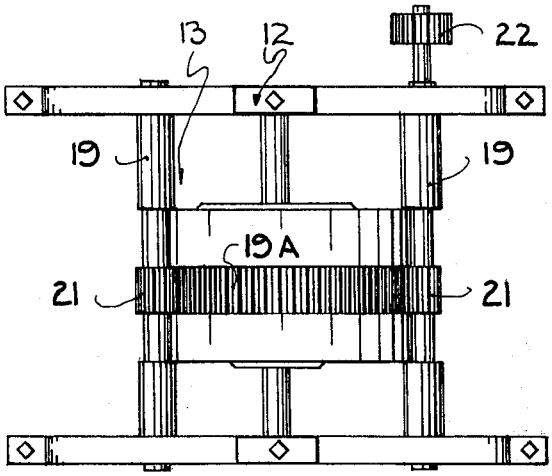
FIG. 3 is a top plan view thereof.
Figure 4:
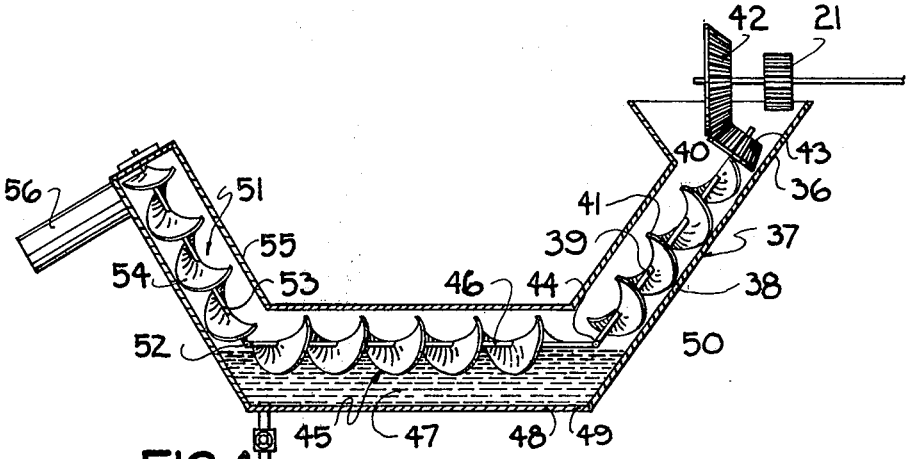
FIG. 4 is a partially schematic cross sectional view of the metal separating device.

Proceeding therefore to describe the invention in detail, reference should first be made to FIGS. 1, 2 and 3 which shows an ore mill collectively designated 10 including supporting structure such as base 11 and a pair of spaced apart upwardly extending bearing support members 12.

Figure 5:
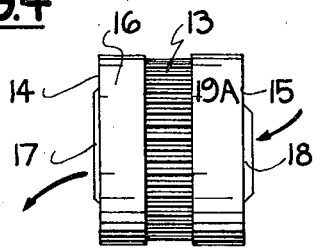
FIG. 5 is a rear elevation of the ore drum per se.

A cylindrical ore drum collectively designated 13 is provided and is shown in detail in FIG. 5. This ore drum includes end walls 14 and 15 together with a circular peripheral wall 16, wall 14 having a relatively large diameter discharge opening 17 co-axial with the axis of the drum and wall 15 having a smaller diameter inlet 18 also co-axial with the axis of the drum.

Means are provided to support the drum for rotation within the supporting structure, said means including an outer annular ring gear 19A formed around or otherwise provided on the periphery of the drum intermediate the ends thereof.

A pair of spaced and parallel shafts 19 are journalled for rotation in spaced apart transverse relationship, within bearing blocks 20 on either side of the supporting structure 12, said shafts including gears 21 secured thereto intermediate the ends thereof.

These shafts and gears are positioned so that the drum nests between the shafts with the ring gear 18 engaging the spur gears 21 as clearly shown.

One of the shafts 19 extends beyond the bearing 20 and includes a gear 22 secured thereto which may be connected to a further gear 23 secured to shaft 24 extending from a source of power 25 which preferably takes the form of a small gasoline engine shown schematically in FIG. 1.

A cylindrical crushing roller 26, having a diameter smaller than the internal diameter of the drum 13, is situated within the drum and secured to a shaft 27 which extends freely through the inlet 18 and the outlet 17 of the walls 15 and 14 respectively. This shaft is mounted for rotation within bearing blocks 28 slidable vertically within guides 29 extending upwardly from the supporting structure 12.

Compression springs 30 react between the upper ends 31 of the guides 29 and the upper side of the bearing blocks 28 normally urging the bearing blocks downwardly and the pressure of these springs 30 is adjustable by means of a screw threaded bolt assembly 32 screw threadably engaging the upper cross piece 33 of the guides 29 thus applying selective pressure from the shaft 27 and hence upon the crushing roller 26.

In operation, insofar as the mill is concerned, crushed ore is fed through a hopper 34 into the intake 18 of the drum together with water supplied through a water conduit 35 and the drum is rotated so that the ore passes between the crushing roller 26 and the lower periphery of the inside of the drum with the pressure between the roller and the ore being controlled by the springs 30 adjusted by the screw threaded bolts 32.

This provides a fine sludge or flour of ore and water which is discharged through the outlet 17 which is of a larger diameter than the inlet 18, into a collecting hopper 36 and the rate of discharge is controlled by the rate of entry of the crushed ore and water.

The hopper 36 extends to a metal separating device collectively designated 37 which is supported upon the supporting structure 10 and consists of a conduit 38 extending downwardly at an angle from the hopper 36 and which contains a conveyor collectively designated 39. This conveyor is preferably a screw type conveyor having shaft 40 with a flight 41 extending therearound and bearing against the inside of the casing 38.

This is driven by a skew gear 42 secured to one of the shafts 19 engaging a corresponding skew gear 43 secured to the upper end of shaft 40.

A universal joint 44, at the lower end of shaft 40, connects this conveyor with a horizontally situated screw conveyor 45 including a shaft 46 with auger flights 47 therearound, running within a substantially horizontal casing 48. This casing also contains a mercury bed 49, with the level 50 of the mercury being substantially level with the longitudinal axis of shaft 46 so that the conveyor is partially submerged within the mercury bed.

A third conveyor assembly 51 is provided extending at an angle upwardly from the other end of the conveyor 45 and consists of a universal joint 52 to which shaft 53 is secured, said shaft having an auger flight 54 therearound and running within casing 55 extending upwardly to a discharge 56 as clearly shown.

In operation, the crushed ore and water forming the sludge is deposited within the hopper 36 and is conveyed by the auger assembly 37 to the beginning of the mercury bed whereupon the auger assembly 45 moves the sludge through and along the mercury bed to the far end thereof whereupon it is augered upwardly to the discharge 56, by means of the auger assembly 51.

The mercury extracts the gold in the form of an amalgam with the discharged sludge being conveyed to any remote discharge point by means of the discharge 56.

It will therefore be seen that there is provided a portable ore mill and separating device particularly suitable for use with small claims and which can be driven easily by means of a small gasoline engine.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. An ore mill and metal separating device, said separating device comprising in combination means to receive the mill sludge from the ore mill, conveyor means conveying said sludge from said means to receive same, a mercury bed, said conveyor moving said sludge to one side of said bed and through said bed and discharging means at the other end of said bed, said separating device including a first solid blade type screw conveyor portion inclining downwardly at an angle from said means to receive the mill sludge, a substantially horizontal container for said mercury bed, a central, solid blade type screw conveyor spanning said container and being partially submerged in the mercury within said mercury bed and being operatively connected by one end thereof to one end of said first conveyor portion, and a third solid blade type screw conveyor portion inclining upwardly at an angle from the other end of said bed and being operatively connected by one end thereof to the other end of said central screw conveyor thereby forming a continuous articulated conveyor assembly.

2. The invention according to claim 1 which includes conveyor casings surrounding said first and third screw conveyors.

3. The invention according to claim 1 in which said mill includes supporting structure, a drum, means to support said drum for rotation within said supporting structure, a source of power for said drum, said drum having a pair of side walls and a circular surrounding wall, an ore intake in one of said side walls, a crushed ore outlet in the other of said side walls and a crushing roller in said drum, shaft means extending through said inlet and outlet in the side walls of said drum, said roller being secured to said shaft means and means on said supporting structure mounting said shaft means for rotation within said drum, said means including means to adjust said roller vertically whereby the distance between the periphery of said roller and the lower side of said drum, is adjustable.

4. The invention according to claim 3 in which said last mentioned means is spring loaded normally urging said roller towards said lower side.

5. The invention according to claim 4 in which said means to support and drive said drum for rotation includes a pair of spaced and parallel shafts in said supporting structure, a spur gear on each of said shafts, a ring gear around the outside of said supporting wall of said drum, said ring gear engaging said spur gears, said spur gears cradling said drum for rotation therebetween and a source of power operatively connected to one of said shafts.

6. The invention according to claim 3 in which said means to support and drive said drum for rotation includes a pair of spaced and parallel shafts in said supporting structure, a spur gear on each of said shafts, a ring gear around the outside of said supporting wall of said drum, said ring gear engaging said spur gears, said spur gears cradling said drum for rotation therebetween and a source of power operatively connected to one of said shafts.

* * * * *